US011504596B2

(12) United States Patent
Dowty et al.

(10) Patent No.: US 11,504,596 B2
(45) Date of Patent: Nov. 22, 2022

(54) GOLF TRAINING PLATFORM

(71) Applicant: BKB Web Marketing, LLC, Sikeston, MO (US)

(72) Inventors: Daniel Dowty, Sikeston, MO (US); Kenneth Vaughn, Sikeston, MO (US)

(73) Assignee: BKB WEB MARKETING, LLC, Sikeston, MO (US)

( * ) Notice: Subject to any disclaimer, the term of this patent is extended or adjusted under 35 U.S.C. 154(b) by 0 days.

(21) Appl. No.: 17/448,767

(22) Filed: Sep. 24, 2021

(65) Prior Publication Data

US 2022/0105412 A1 Apr. 7, 2022

Related U.S. Application Data

(60) Provisional application No. 63/088,659, filed on Oct. 7, 2020.

(51) Int. Cl.
*A63B 69/36* (2006.01)

(52) U.S. Cl.
CPC ..... *A63B 69/3661* (2013.01); *A63B 69/3691* (2013.01); *A63B 2069/3664* (2013.01)

(58) Field of Classification Search
USPC ..... 473/150, 157, 218, 257, 262, 278, 279
See application file for complete search history.

(56) References Cited

U.S. PATENT DOCUMENTS

| | | | | |
|---|---|---|---|---|
| 4,130,283 | A * | 12/1978 | Lindquist | E01C 13/08 473/262 |
| 4,875,685 | A | 10/1989 | Ballinger et al. | |
| 4,932,663 | A | 6/1990 | Makar | |
| 4,955,611 | A | 9/1990 | Moller | |
| 5,273,285 | A | 12/1993 | Long | |
| 5,340,109 | A | 8/1994 | Miller | |
| 5,390,925 | A | 2/1995 | Wiltse | |
| 5,549,299 | A * | 8/1996 | Brown | A63B 57/0006 473/133 |
| 5,692,967 | A | 12/1997 | Guyer | |
| 6,135,895 | A | 10/2000 | Estivo et al. | |
| 6,623,373 | B2 | 9/2003 | Carlton et al. | |
| 6,746,340 | B1 * | 6/2004 | Dover | A63B 69/3661 473/278 |
| 7,384,346 | B2 * | 6/2008 | McFarlin | A63B 69/3661 473/278 |
| 7,549,932 | B1 | 6/2009 | Miyamota | |
| 7,568,980 | B1 | 8/2009 | Janus et al. | |

(Continued)

*Primary Examiner* — Nini F Legesse
(74) *Attorney, Agent, or Firm* — Sandberg Phoenix & von Gontard PC

(57) ABSTRACT

A golf practice device comprises a main frame which contains a compressible energy transfer pad and a flexible turf section which rests atop the energy transfer pad. The turf section is secured in the frame only along a forward end of the turf section. Additionally, the turf section is secured to the energy transfer pad at an end opposite from the forward end or along a length of the energy transfer pad. Thus, when the turf section is struck by a swinging golf club, the turf section will flex, bend and move relative to the frame, thereby simulating the feel of creation of a divot. A tee box may be removably attached to the frame for allowing a golfer to practice teeing off. Multiple main and tee boxes may be attached together, both lengthwise and widthwise.

18 Claims, 16 Drawing Sheets

(56) References Cited

U.S. PATENT DOCUMENTS

| | | | | |
|---|---|---|---|---|
| 8,157,667 | B2 * | 4/2012 | Tome | A63B 69/3623 473/150 |
| 8,911,300 | B1 * | 12/2014 | Alvarado | A63B 69/3661 473/262 |
| 9,162,133 | B2 | 10/2015 | Schroer | |
| 2006/0128493 | A1 | 6/2006 | Snopkowski | |
| 2008/0032811 | A1 | 2/2008 | Bearden | |
| 2011/0070965 | A1 | 3/2011 | Tome et al. | |
| 2011/0124427 | A1 | 5/2011 | Green et al. | |
| 2012/0178546 | A1 * | 7/2012 | Park | A63B 69/3673 473/278 |
| 2014/0373476 | A1 * | 12/2014 | Curtis | E01C 13/083 52/480 |

* cited by examiner

GOLF TRAINING PLATFORM

CROSS-REFERENCE TO RELATED APPLICATIONS

This application claims priority to U.S. App. No. 63/088,659 filed Oct. 7, 2020, which is entitled "Golf Training Platform" and which is incorporated herein by reference.

STATEMENT REGARDING FEDERALLY SPONSORED RESEARCH OR DEVELOPMENT

Not Applicable.

BACKGROUND

This application relates to a golf training platform, and in particular, to a golf training insert that simulates the "reaction and feel" of golf course turf better than existing golf practice mats.

Perfecting one's golf swing has become both a calculation and a science. It has become increasingly popular for golf enthusiasts to look for a variety of ways beyond simply practicing on the golf course or practicing their golf swing at a standard driving range.

Custom designed golf practice devices have been in existence for many years. Many attempts have been made to simulate the true behavior of turf on the actual golf course. However, one large problem that is common to many existing artificial turf practice mats is that they do not provide a realistic experience when practicing hitting golf balls on a fairway (as opposed to putting or teeing-off). A typical practice mat comprises a section of artificial turf which is bonded to, and is atop, a hard (rubber) base. Hence, the turf does not give, bend, or otherwise yield. In no way does this allow the golfer to simulate the actual taking of a divot out of the artificial turf surface. Today's golf mats allow a golfer to practice the golfer's swing but does not focus in on the actual impact and release of the golf ball and/or the ground that the golf ball lies on. The existing golf mats thus do not simulate the actual green or fairway, and thus do not accurately simulate the feel of a golf swing when the club contacts the ball and ground. To simulate the feel of a golfing, it is important to simulate two crucial characteristics. First, to allow the clubface to penetrate and redirect the turf for an accurate launch angle based off the golf ball lie and the loft angle needed. Second, to simulate a wide range of divot depths that are taken out of the turf during the follow-through swing which allows for the proper amount of needed backspin for an accurate check and release of the golf ball when it contacts the ground after flight.

Further, current practice mat designs suffer from the problem that the vibrations/shaft-sting from hitting the mat (which is bonded to a hard surface) is transmitted up the golf club shaft to the golfer's hands. Because of the shortcomings of the existing golf swing practice mats, it is said these existing golf mats allow for a golfer to practice the nuances of his/her swing but miss out on many facets needed to be able to truly practice the game of golf.

BRIEF SUMMARY

Briefly stated, we have provided a training platform that provides a golf hitting surface that addresses the limitations noted above.

In accordance with an aspect of the golf training platform, the golf training platform comprises a main frame having first and second side members fixed in a position relative to each other, a turf bracket pivotally mounted between the first and second side members of the frame to pivot about an axis substantially perpendicular to the side members; and a turf section secured to the turf bracket proximate a first end of the turf section. The turf section comprises a flexible turf-simulating material and is secured in the frame only along the first edge of the surf section; whereby the turf section is capable of deforming, flexing, and bending upon being contacted by a swinging golf club.

The turf section in the main frame preferably is part of a turf assembly which also includes a compressible energy transfer pad. The turf section and energy transfer pad preferably have substantially the same side-to-side width. However, the energy transfer pad need not extend all the way to the first edge of the turf section, where the turf section is secured to the turf bracket. In one version of the turf assembly, the turf section is secured to the energy transfer pad. The turf section can be secured to the energy transfer pad proximate an end of the turf section remote from the first edge of the turf section or along substantially the full length of the energy transfer pad. In the latter instance, the turf section and energy transfer pad are joined together, for example, by stitching, proximate the side edges of the turf assembly. Additionally, the turf assembly can include a web reinforcement adhered to a face of the energy transfer pad, the web reinforcement extending substantially the length of the energy transfer pad. Additionally, the turf assembly can include a flexible strap having one end connected to the turf assembly proximate a second end of the turf section and a second end connected to the frame, whereby the flexible strap has a length sufficient that there be at least some slack in the strap.

The energy transfer pad is preferably compressible and composed of an open cell or porous foam.

In accordance with an aspect of the golf training platform, the turf bracket comprises a rocker plate to which the turf section is secured. In one embodiment of the turf bracket, the turf bracket includes a hold down plate; whereby the turf section is clamped between the rocker plate and the hold down plate. In a preferred embodiment, the turf section is removably secured to the rocker plate.

To removably secure the turf section or turf assembly to the turf bracket, the turf bracket can comprise a plurality of positioning members. The turf assembly defines a plurality of notches at the forward end that align with positioning members. The positioning members are movable between a clamped position and an unclamped position; wherein in the clamped position, the turf assembly is secured to the turf bracket, and in the unclamped position, the turf assembly is removable from the turf bracket.

In accordance with another aspect, the golf platform can include a tee box secured to the main frame. The tee box comprises a pair of opposed sides and a pair of opposed ends which in combination define an enclosed space and a tee box turf section received in the enclosed space.

In accordance with an aspect of the golf training platform, the golf training platform includes at least one fastener configured to attach the tee box to the main frame. In an embodiment, at least one of the sides of the main frame comprises at least one hole, and at least one of the sides of the tee box comprises at least one hole; wherein the side holes of the main frame and the tee box are positioned to be aligned when the tee box is adjacent to the main frame. The fastener comprises a rod passing through the respective holes when the frame and the tee box are adjacent.

In accordance with an aspect of the golf training platform, the turf assembly defines an upwardly opening depression or hole sized such that when a golf ball is positioned in the depression or hole, a bottom of the golf ball will be below a top surface of the turf assembly a desired amount.

BRIEF DESCRIPTION OF THE DRAWINGS

Corresponding reference numerals will be used throughout the several figures of the drawings.

DETAILED DESCRIPTION

Figure 1:
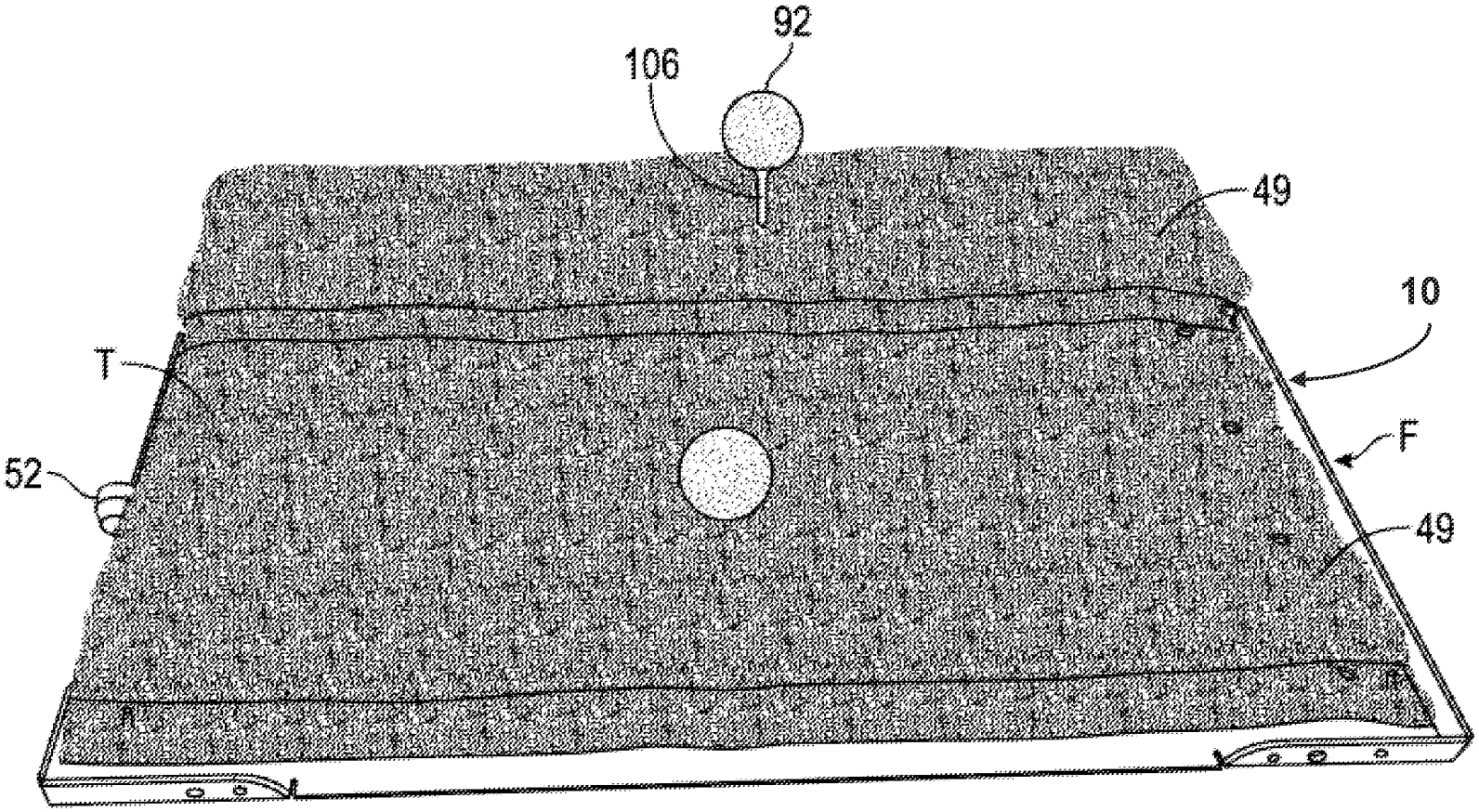
FIG. 1 is a perspective view of a main frame of the golf training platform in an "at rest" position with a tee box attached to the main frame, and golf balls placed on the main frame and the tee box.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what we presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 2B:
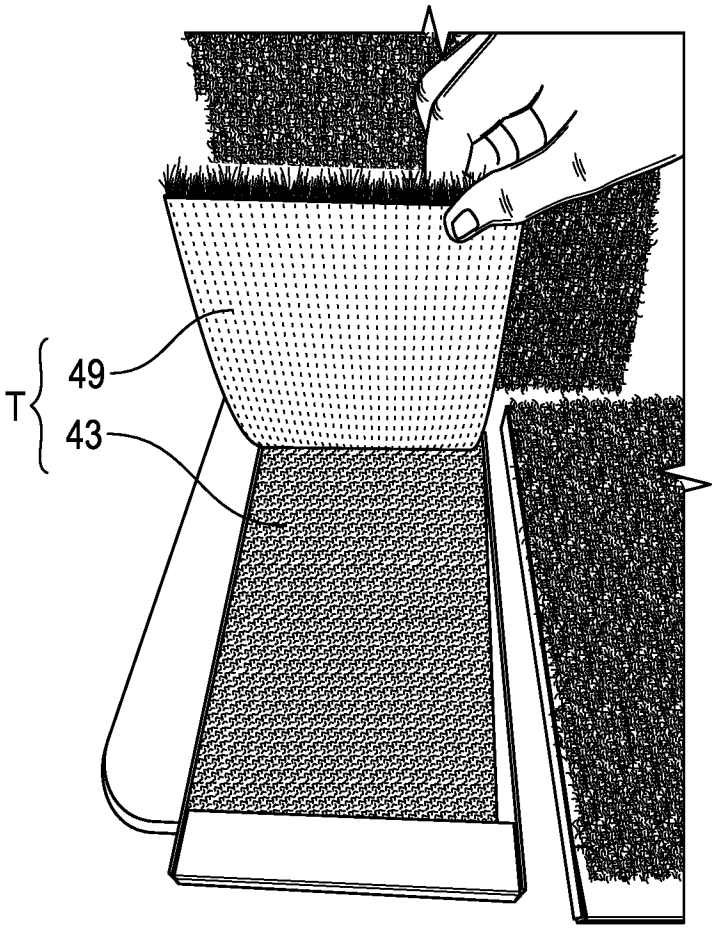
FIGS. 2A-B are front perspective views of an alternative main frame with the flexible turf section in an "at rest" position and a lifted position, respectively.

An illustrative golf training platform 10 is shown in FIGS. 1-2B. The golf training platform comprises a main frame F in which a turf assembly T is mounted. The turf assembly T in the main frame comprises a turf section 49 and a resilient energy absorbing pad 43. As described below, the golf training platform includes a turf bracket (not visible in FIGS. 1-2B) mounted in the main frame proximate a first or front end of the main frame and to which the turf assembly is mounted. The turf assembly is mounted in the frame only proximate the forward edge of the turf assembly, such that the turf assembly can flex, bend, and otherwise move relative to the main frame when it is struck by a golf club, to thereby simulate a golf club hitting turf and forming a divot. As seen in FIGS. 2C-D, when hit with a golf club C, the turf assembly will move forward relative to the main frame and will form essentially a wave at the front of the main frame. The ability to form the wave as seen in FIG. 2C is enabled by the ability of the turf bracket to pivot forwardly in the frame. As shown in FIG. 2D, as the golfer G completes the swing, the rear of the turf assembly T will lift up slightly. Thus, as the golf club impacts the turf assembly, the energy is transferred through the turf section to the energy absorbing pad, and the turf assembly pivots forward based off the action of the pivotal turf mount. At the same time the turf assembly is released to simulate the flight of the turf divot allowing that energy to follow through with the golf swing.

Figure 3A:
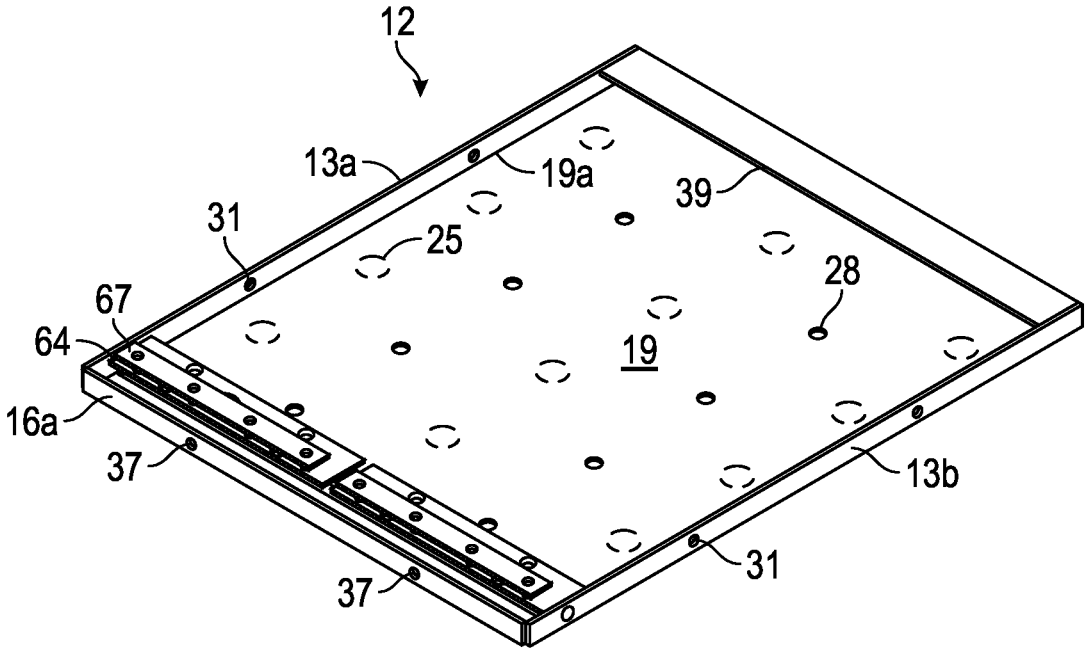
FIG. 3A is a perspective view of a first embodiment of the main frame of the golf training platform with a first embodiment of a turf bracket which secures the turf section in the main frame.
Figure 3B:
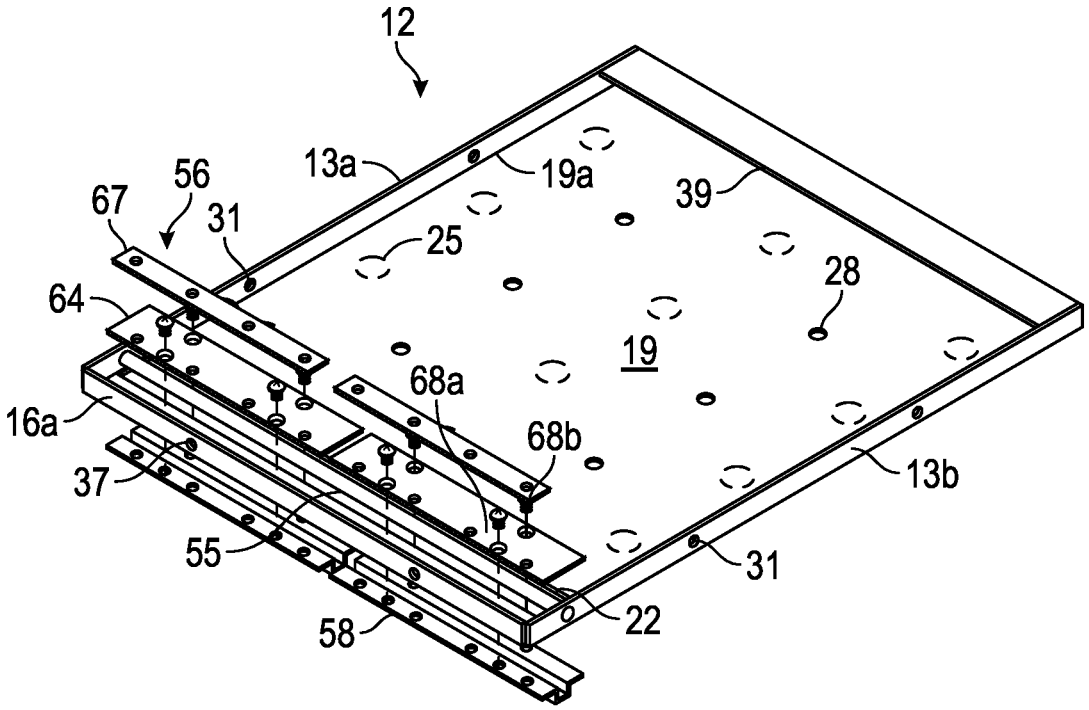
FIG. 3B is an exploded perspective view of the main frame of FIG. 3A.
Figure 3C:
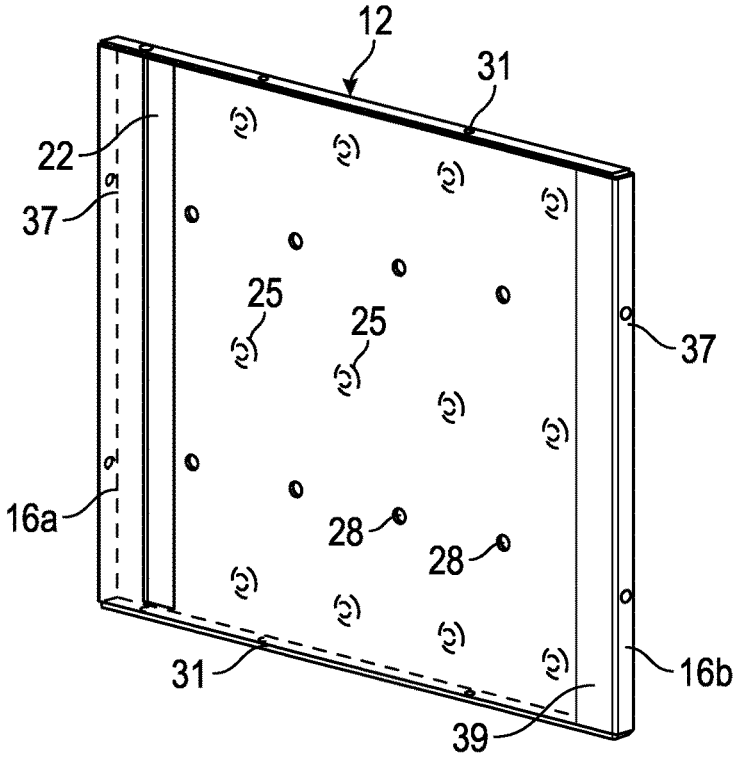
FIG. 3C is a second perspective view of the main frame taken 180° from the view of FIG. 3A, but without the turf bracket.
Figure 3D:
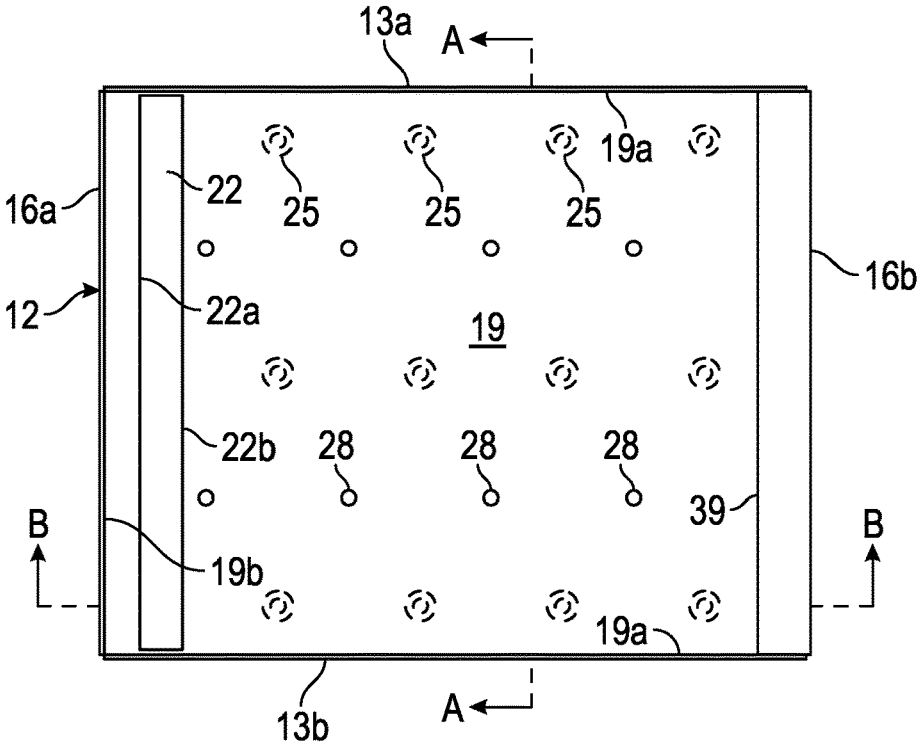
FIG. 3D is a top plan view of the main frame without the turf bracket.
Figure 3E:
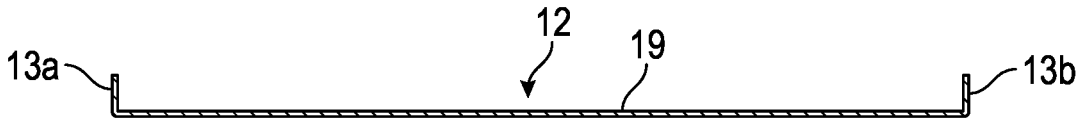
FIG. 3E is a lateral cross-sectional view of the main frame taken along line A-A of FIG. 3D.
Figure 3F:
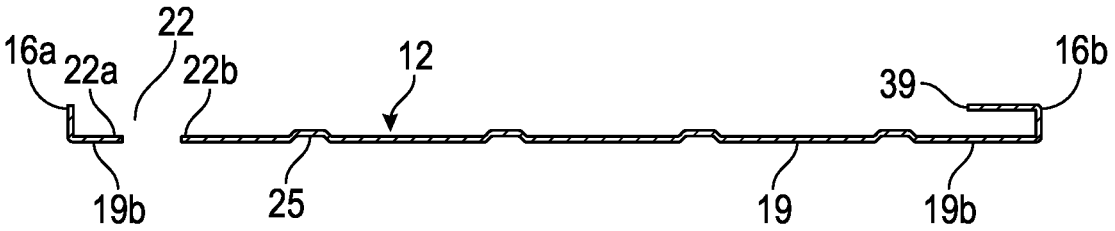
FIG. 3F is a longitudinal cross-sectional view of the main frame along line B-B of FIG. 3D.
Figure 3G:
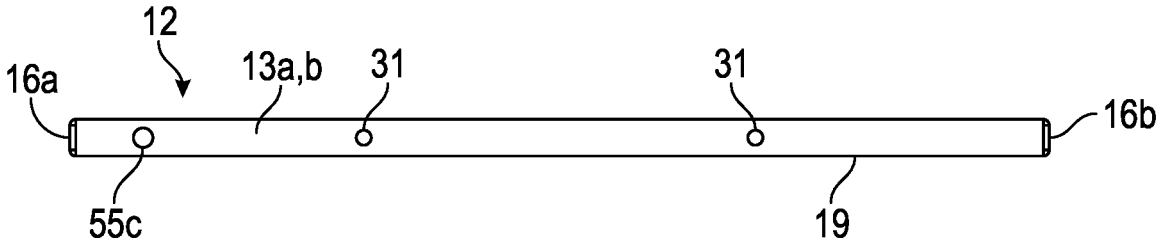
FIG. 3G is a side elevational view of the main frame.
Figure 4B:
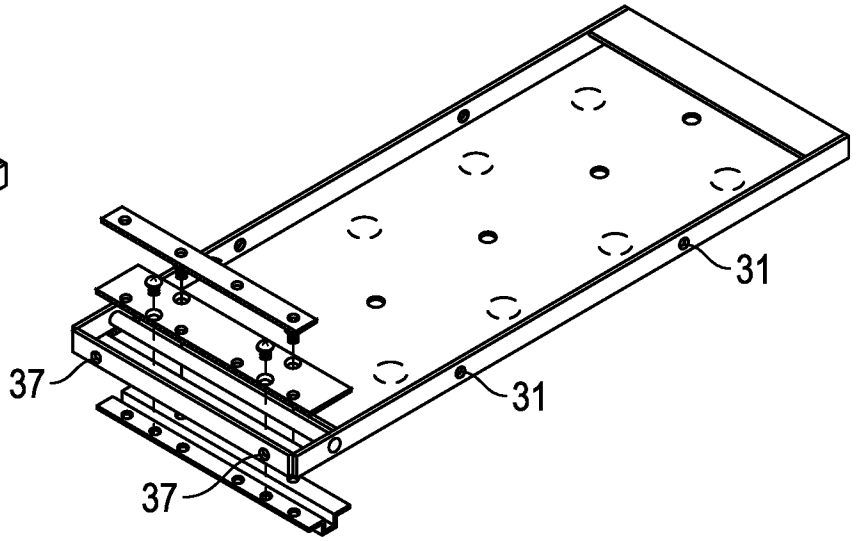
FIGS. 4A-B are a perspective and exploded views, respectively, of a variation of the first main frame, this main frame being smaller than the main frame of FIG. 3 and being provided with the first turf bracket.
Figure 4A:
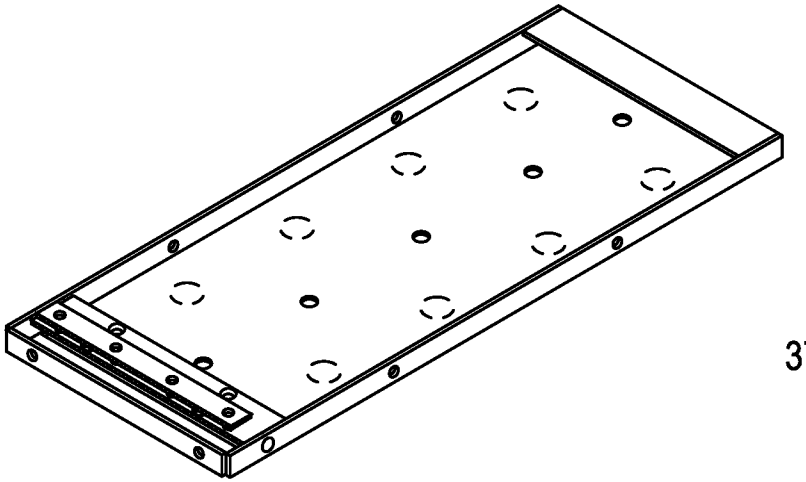

A first embodiment of the main frame 12 is shown in FIGS. 3A-3G, and a variation of the main frame 12 is shown in FIGS. 4A-B. The main frame of FIGS. 3A-G is a "double" frame and is twice the width of the frame shown in FIGS. 4A-B. The frame of FIGS. 4A-B can thus be termed a "single" frame. The two frames are otherwise identical.

The main frame 12 comprises first and second side members 13*a*, 13*b*, first and second end members 16*a*, 16*b*, and a floor 19 extending between the side members 13*a*, 13*b* which forms a bottom surface of an interior space defined by the first and second side members 13*a*, 13*b* and the first and second end members 16*a*, 16*b* of the frame 12. The first and second side members 13*a*, 13*b* and first and second end members 16*a*, 16*b* extend generally perpendicularly upwardly from the side edges 19*a* and end edges 19*b* of the floor in an L-like configuration. A slot 22 is formed in the floor 19 proximate the first end member 16*a*. The slot 22 extends generally parallel to the first end member 16*a* and extends substantially the full width of the floor 19 between the first and second side members 13*a,b*. The slot 22, as seen in FIG. 3D is generally rectangular in shape but may be in the shape of an elongated oval or the like. The slot comprises a proximate side 22*a* that is nearer to the first end member 16*a* and a distal side 22*b* that is positioned further from the first end member 16*a*.

A plurality of projections 25 protrude upwardly from the surface of the floor 19. The projections 25 are each shown to have a hole at their respective tops. The projections 25 of the main frame 12 are shown in FIG. 3A to be arranged in three rows of four projections, with the projections evenly spaced apart along the rows. The main frame of FIGS. 4A-B is shown with two rows of projections 25. The projections 25 could be arranged in any desired pattern about the floor 19. Additionally, the main frame 12 includes a plurality of drain holes 28 are formed in the floor 19 in a similar configuration as the projections portions 25. The drain holes are shown to be arranged in two rows of four drain holes each, with the rows of drain holes being between the rows of raised projections 25. The double frame thus shown with two rows of drain holes and the single frame is shown with one row of drain holes. The drain holes 28 will allow for liquid to drain through the bottom of the golf practice device. Fasteners, such as bolts, screws, or the like, can pass through the drain holes 28 or the holes of the projections 25 to secure the golf practice platform 10 in place on a surface.

The side members 13*a,b* and end members 16*a,b* include holes 31 and 37, respectively. As will be described below, these holes facilitate the connection of multiple frames in a side-to-side relationship and/or in a tandem (end-to-end) relationship.

A lip 39 is extends inwardly from the top edge of the second end member 16*b* to extend over the floor 19 for a short distance. The lip 39 extends from the top edge of the second end member 16*b* towards the first end member 16*a*, thereby creating inverted L-like configuration. The lip 39 extends along the length of the second end member 16*b* between the first and second side members 13*a*, 13*b*.

A turf assembly is positioned within the frame. The turf assembly comprises a cushion or energy transfer pad 43 and a turf section 49.

The cushion or energy transfer pad 43 (FIG. 2B) is positioned within the interior space of the frame 12 defined by the side members 13*a*, 13*b* and the end members 16*a*, 16*b*. In the frame 12, one end of the energy transfer pad will be received beneath the lip 39. The energy transfer pad is composed of a deformable material, such as a compressible like foam which provides a life like compression feel when struck on the downward swing of a golf club similar to that of turf on a golf course and which will absorb the forces of an impact from a golf swing, so that the energy of the impact is not transmitted back up the shaft of the golf club. Preferably, the energy transfer pad is made from a woven or expanded polyester foam which provides an open cell foam that allows air and liquid to pass through the foam with little to no resistance. A preferred material for the energy transfer pad is a reticulated foam, which can be a polyester, polyether, or polyurethane foam having a PPI (pores per inch) of less than 20, and preferably of about 10. Other materials could be used as well, as long as they have the requisite energy absorption and transfer characteristics of the pad 43. The energy transfer pad 43 is sized to extend generally fully between the side members 13*a,b* of the main frame (so that it cannot move laterally within the frame), and to extend from the second end member 16*b* to the slot 22, such that the energy transfer pad 43 does not cover the slot 22. The energy transfer pad thus does not extend the full length of the main frame 12. In the frame 12, the energy transfer pad extends beneath the lip 39, and thus is generally stationary relative to the frame. In this embodiment, only the turf section 49 moves when struck with a golf club.

When positioned within the interior space, the bottom surface of the energy transfer pad 43 will rest atop the top surfaces of the projections 25, thereby setting within the interior space elevated from the surface of the floor. This provides for a slight gap to allow for liquid to drain from the energy transfer pad 43 and to ultimately drain from the main frame 12 through the drain holes 28 in the floor 19.

Figure 2A:
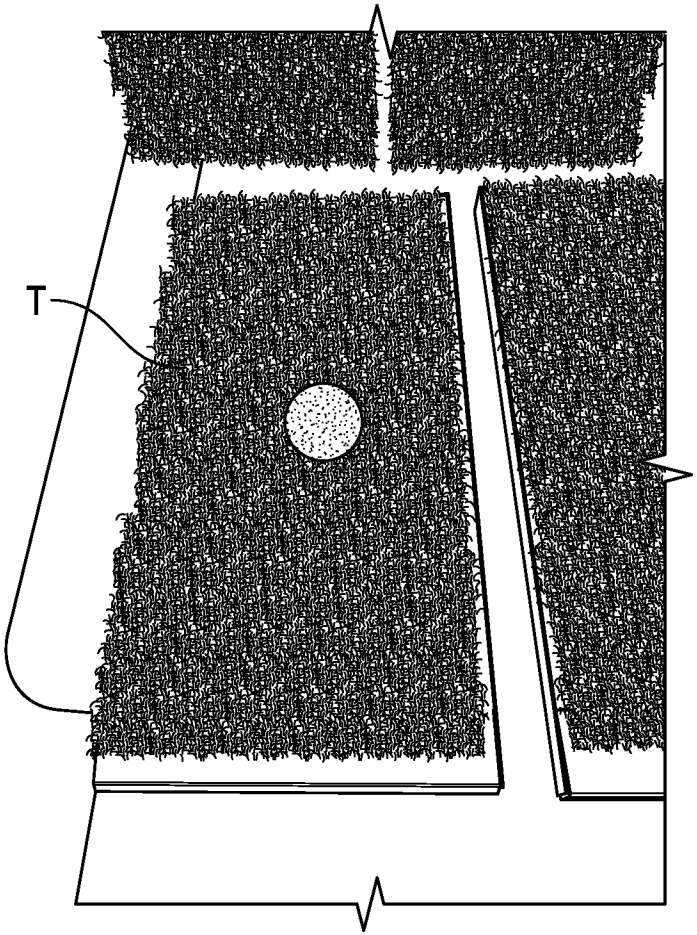
Figure 8:
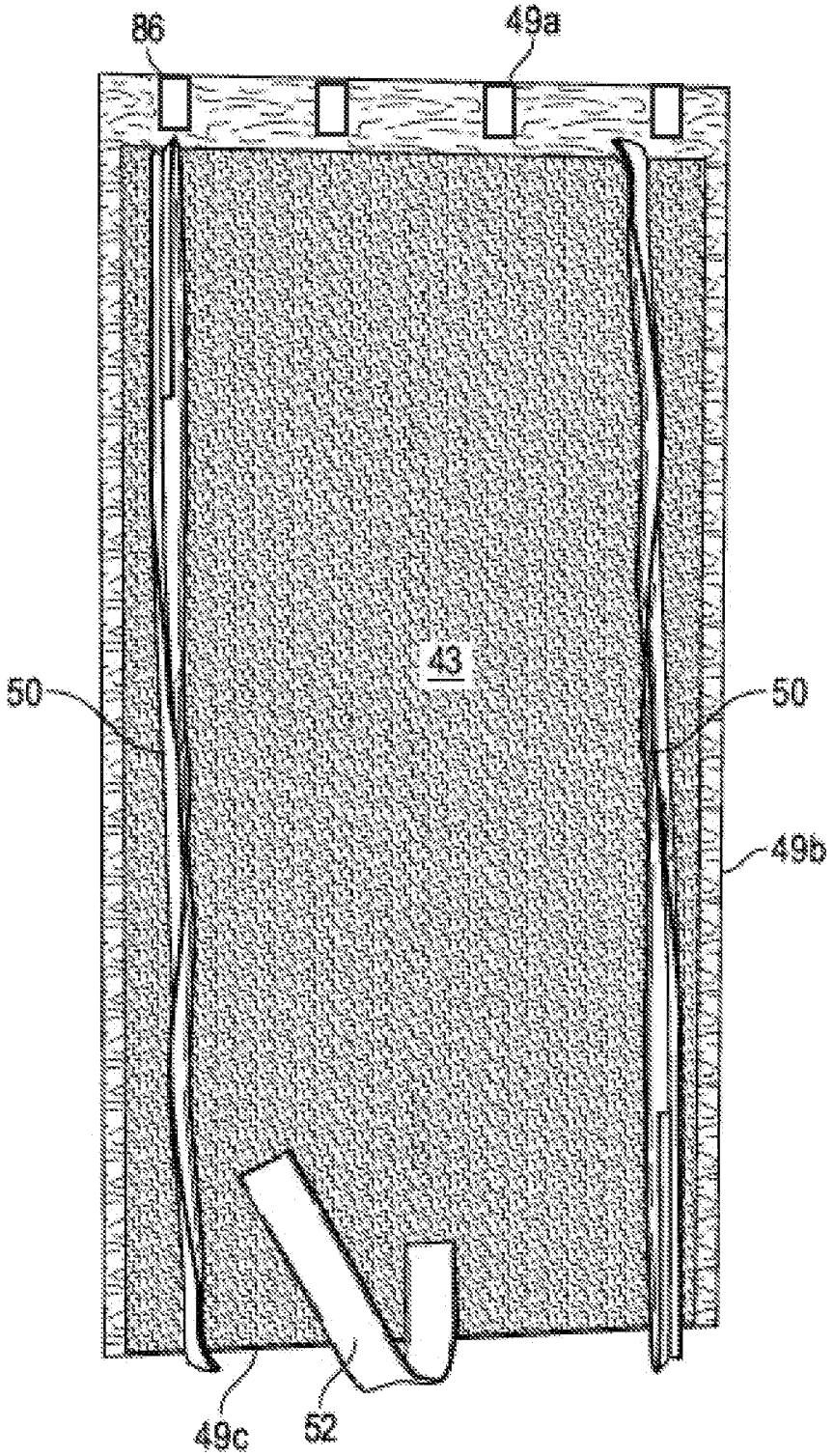
FIG. 8 is a bottom perspective view of a turf assembly showing the energy transfer pad secured to the turf section along the side edges of the energy transfer pad and a hold-down strap.
Figure 9:
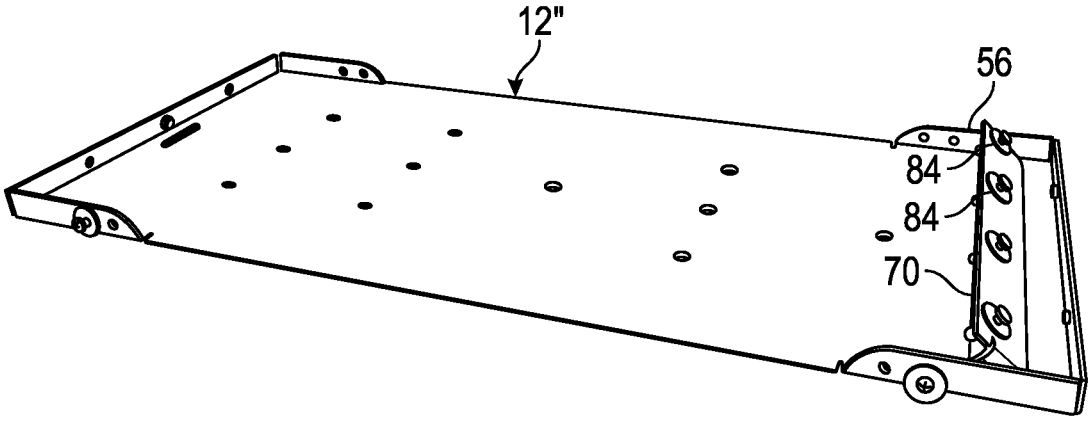
FIG. 9 is a perspective of the main frame of FIG. 7 when assembled with the turf bracket pivoted forwardly and including fasteners to connect the main frame to another frame.

The turf section 49 is positioned above the energy transfer pad 43. The turf section 49 has a length such that it extends from proximate the end member 16*a* of the frame to at least the forward edge of the lip 39. The turf section preferably extends slightly over the lip 39, as seen in FIG. 2A. In one version, the turf section 49 can extend substantially the full width of the frame. However, as seen in FIG. 3A, the frame can accommodate two turf sections, which are arranged side by side in the frame, and which each have width about one-half the width of the main frame 12. The turf section comprises a first end edge 49*a* that is positioned proximate and generally parallel to the first end member 16*a*, and side edges 49*b* that extend generally parallel to the side members 13*a*, 13*b*, and a second end edge 49*c* that is proximate the second end member 16*b*. When resting atop the energy transfer pad 43, the first end edge 49*a* is positioned to extend generally parallel and above the slot 22 along the first end member 16*a*. The turf section 49 is comprised of a flexible artificial turf material that simulates a desired grass type and depth. The turf section is flexible and deformable. In one version, the turf section 49 is not adhered to the energy transfer pad 43, such that the turf section is secured in place only along its first edge 49*a*. This, allows for the turf section to flex, deform, and even lift up or separate from the energy transfer pad when struck on the downward swing of a golf club. In an alternate version, the turf section 49 is secured to the energy transfer pad 43 along the second end edge 49*c* of the turf section. In this version, the turf section is secured in the main frame along the first end edge 49*a* of the turf section. Thus, in this version, the turf section is secured at one end to the frame and at the opposite end to the energy transfer pad. In a variation, web reinforcements 50 (FIG. 8) extend the length of the energy transfer pad proximate the side (long) edges of the energy transfer pad. If desired, a single web reinforcement could be provided which would extend, for example, along the middle of the energy transfer pad. Alternatively, three, four (or more) web reinforcements could be provided. The web reinforcements 50, energy transfer pad 43, and turf section 49 are secured together, for example, by stitching which passes through all three layers. As seen, the web reinforcement 50 is positioned on the bottom face of the energy transfer pad, but could be positioned between the turf section and the energy transfer pad. In these versions (where the turf section and energy transfer pad are connected together), the turf section will still be able to flex, deform, and move when struck on the downward swing of a gulf club, as shown in FIG. 2A. However, the energy transfer pad will move with the turf section. By connecting the turf section to the energy transfer pad, the energy transfer pad may more quickly return the turf section to an "at rest" or flat condition in the main frame, after having been bent, flexed, etc. during a golf swing. In either version, the turf section 49 is capable of lifting, sliding, shifting, moving, or swelling when struck by a golf club on the downswing, thereby simulating the creation of a divot and thus providing a more life-like feel when in use.

Figure 5:
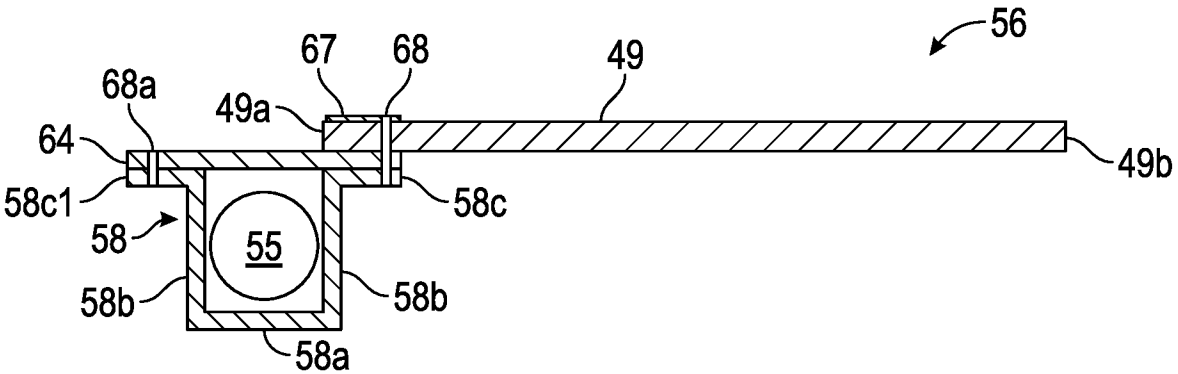
FIG. 5 is an enlarged highly schematic cross-sectional view of a first turf bracket which secures the turf assembly in the main frame.
Figure 6A:
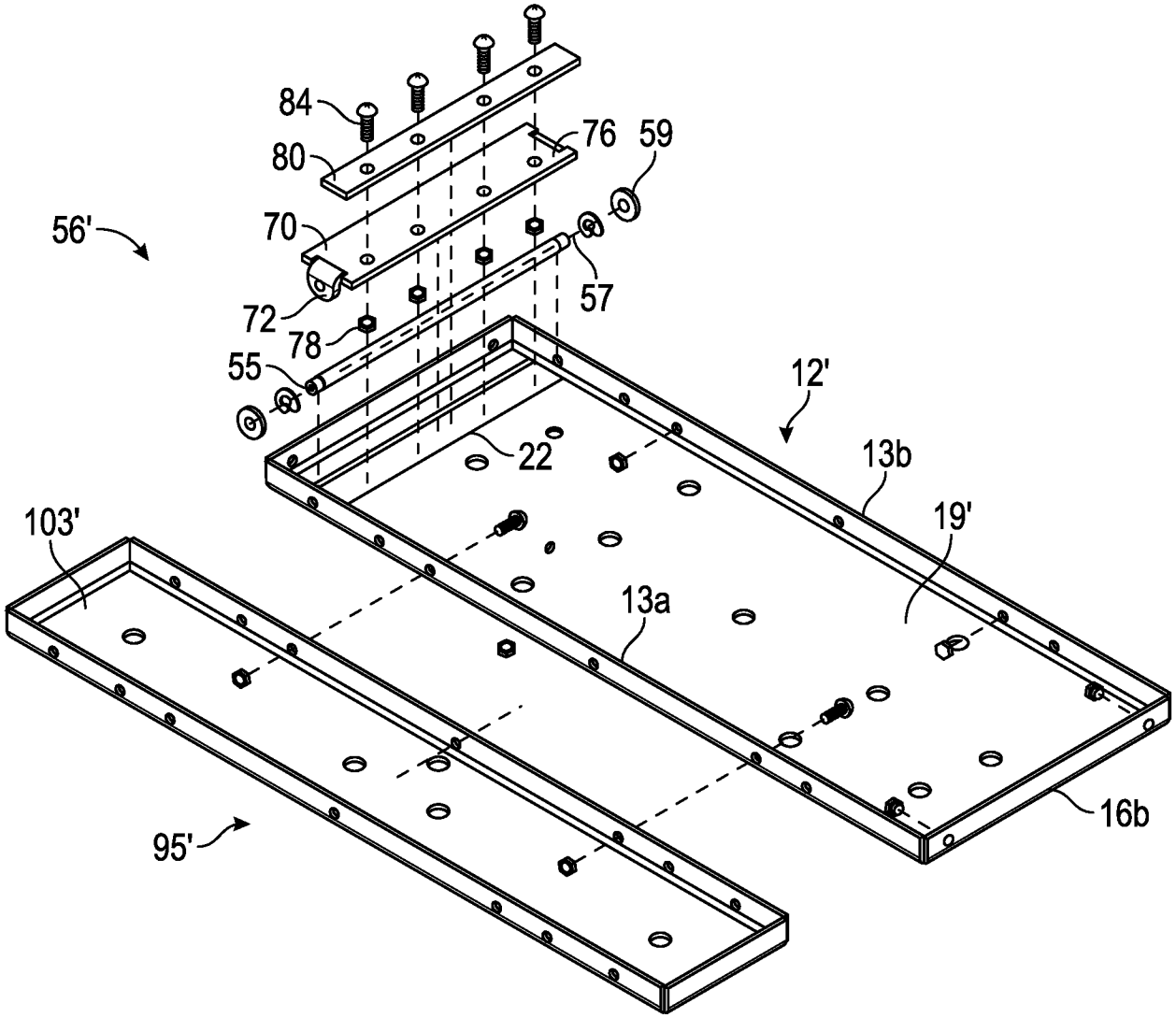
FIG. 6A is an exploded view of a second embodiment of the main frame with a second turf bracket and with a tee box adjacent the main frame.
Figure 6D:
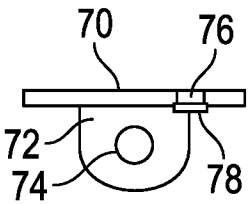
FIG. 6D is an end view of the rocker plate when formed.

The turf section 49 is secured in the main frame 12 by a turf bracket which can pivot or rotate about a shaft 55 extending between the first and second side members 13*a*, 13*b* over the slot 22. A first embodiment of the turf bracket 56 is shown in FIGS. 3B and 5. The shaft 55 can be made of any desired material, but is preferably made from a plastic, such as an acetyl homopolymer (e.g., Delrin®) or from stainless steel. The shaft 55 can be secured to the first and second side members 13*a*, 13*b* in any desired fashion. For example, as seen in FIG. 6A, E-style retaining rings or C-clips 57 can be inserted in slots or grooves formed in the shaft 55 proximate the ends of the shaft. As seen in FIG. 6A, the clips 57 are positioned inside of the frame side members 13*a,b*, and washers 59 are positioned between the clips 57 and the side members 13*a,b*. The washers 59 help reduce noise caused by pivoting of the turf bracket during use, and are therefore preferably plastic, and more preferably, nylon, but can be made of any desired, preferably, low friction, material. The shaft can be positionally fixed, or it can rotate in place about its axis. The shaft 55 can have a length such that its ends do not extend beyond the outer surfaces of the frame side members 13*a,b*, or, as seen in FIG. 6A, the ends of the shaft can protrude slightly beyond the outer surfaces of the side members. The shaft is positioned such that it aligns approximately with a center line that extends along the length of the slot 22. Alternatively, the shaft 55 cold be replaced with aligned axis defining projections which extend inwardly from the side walls of the frame.

One embodiment of the turf bracket 56 (shown schematically in FIG. 5, and exploded in FIG. 3B) comprises an elongate U or hat channel 58 having a bottom surface 58*a*, two side members 58*b* extending upwardly from the bottom surface 58*a*, and flanges 58*c*1 and 58*c*2 which extend outwardly from the tops of the side members 58*b*. The flanges 58*c*1 and 58*c*2 both have a plurality of screw holes formed therein. The U-channel 58 is sized to receive the shaft 55 or to fit on axis defining projections. Thus, the bottom surface 58*a* has a front to back width slightly greater than the diameter of the shaft 55. Similarly, the height of the U-channel from the bottom surface to the top surface of the flanges is slightly greater than the diameter of the shaft 55. A rocker plate 64 is positioned to set atop the flange members 58*c*, such that when positioned and secured to the flange members, the rocker plate 64 completely covers the U-shaped channel 58. That is, the rocker plate extends over the flanges 58*c*1 and 58*c*2, and is shown to have a length generally equal to the length of the U-channel 58. The rocker plate 64 has a plurality of screw holes that are aligned with the screw holes in both the first and second flanges 58*c*1, 58*c*2. A top, or hold down, plate 67 is positioned above and generally parallel to the rocker plate 64 and the first flange member 58*c*1. The top plate 67 is generally equal in length to the rocker plate, but is shown to have a width generally equal to the width of the flange 58*c*2, and thus has a width about ½ that of the rocker plate. The top plate 67 includes screw holes aligned with the screw holes in the flange 68*c*2. Screws 68*a* extend through the rocker plate 64 and into the U-channel flange 58*c*1 to secure the rocker plate to the U-channel. Additionally, screws 68*b* extend through the top plate 67 and the rocker plate 64 into the screw holes in the U-channel flange 58*c*2 to secure both the top plate and the rocker plate to the U-channel. As seen, the screws 68*b* extend through the turf section 49.

Figure 6B:
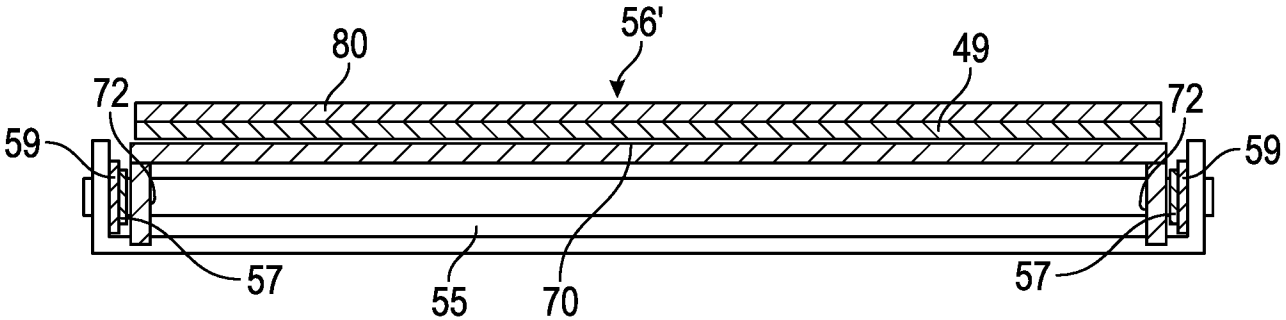
FIG. 6B is a longitudinal cross-sectional view of the main frame taken along a plane extending through the turf bracket.
Figure 6C:
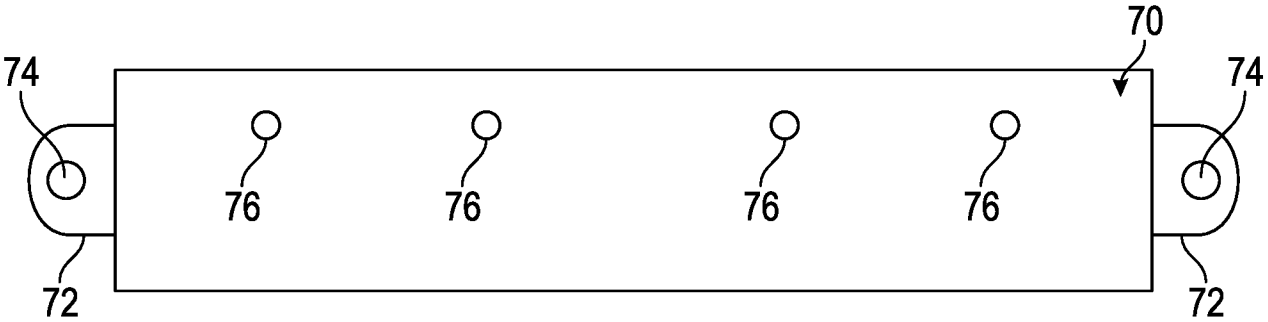
FIG. 6C is a plan view of a blank for a rocker plate of the turf bracket of FIG. 6A.
Figure 6E:
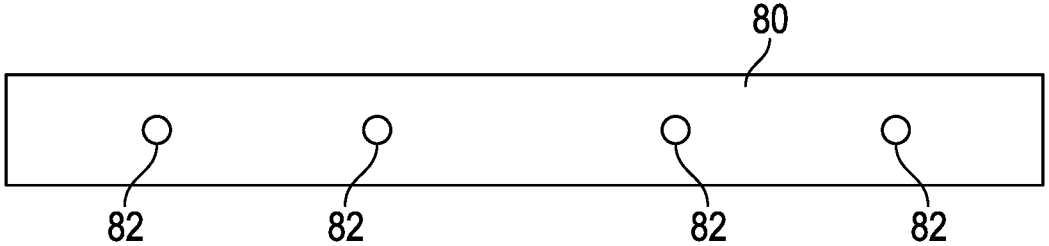
FIG. 6E is a plan view of a top, or hold down, plate of the turf bracket.

A second turf bracket 56' is shown in FIGS. 6A-E. The turf bracket 56' comprises a generally flat rocker plate 70 having downwardly extending, generally U-shaped ears 72 at the opposite sides of the rocker plate 70. The ears 72 have openings 74 which receive the shaft 55 or axis defining projections. Preferably, the openings 74 have a diameter only slightly greater than the diameter of the shaft, so that the rocker plate will not "wobble" about its ends as it rotates. A series of openings 76 extend the across the width of the rocker plate 70 and are positioned slightly rearwardly of the forward edge of the rocker plate. Threaded nuts (or other internally threaded elements) 78 are associated with each opening 76. For example, press fit nuts can be secured in each of the openings 76. As seen in FIG. 6B, the turf section 49 is positioned on top of the rocker plate 70. A top, or hold down, plate 80 is positioned over the turf section 49 to clamp the turf section between the rocker plate and the hold down plate. The hold down plate 80 has a side-to-side width generally equal to that of the rocker plate, and a front-to-back width that is about one-half the front-to-back width of the rocker plate. The hold down plate is positioned such that its forward edge is generally flush with the forward edge of the rocker plate, and its side edges are generally flush with side edges of the rocker plate. The hold down plate includes a series of openings 82 which are positioned to be aligned with holes 76 in the rocker plate. Screws 84 extend through holes 82 of the hold down plate 80, through the turf section 49, through the holes 76 of the rocker plate 70 into the bolts 78 below the holes 76. As can be appreciated, when the screws are tightened down, the turf section 49 will be clamped between the hold down plate and the rocker plate.

As noted, the forward edge 49*a* of the turf section 49 is received between the hold plate 67, 80 and the rocker plate 64, 70, and is clamped in place by the screws. The turf section can be provided with spaced apart holes 86 (FIG. 8) along its forward edge through which the turf bracket screws can extend. Preferably, the holes are in the form of notches or slots extending inwardly from its forward edge 49*a* and positioned to be aligned with the turf bracket screws 68*b*, 84. The provision of the notches in the turf section allows for easy replacement of the turf section. The screws 68*b*, 84 can be loosened to an extent such that the currently installed turf section can be removed. A new turf section is then positioned in place, and the screws 68*b*, 84 are tightened. To facilitate removing and replacing turf sections, the screws 68*b*, 84 can be replaced with any other mechanism which will sandwich the turf section between the clamping plate 80 and the rocker plate 70. For example, the screws 68*b*, 84 could be replaced with posts extending up from the rocker plate and cam med levers or toggle levers which pivot about the post. The use of cammed or toggle levers would allow for the turf to be replaced without the need for tools.

The turf bracket 56, 56' can rotate or pivot about the shaft 55, with the shaft operating as a pivot rod, rotating axis, or the like. As noted above, at a minimum, the turf bracket can pivot forwardly from a flat or level position. This allows for at least the forward end of the turf section to pivot about the shaft 55 as well. The turf bracket is preferably sized to fit a single frame. Thus, a single turf bracket extends across the width of the single frame, as shown in FIG. 6A. Because the double frame is twice the width of a single frame, the double frame can be provided with two turf brackets, as shown in FIG. 3A. The two turf brackets can be spaced apart, for example, by a spacer on the shaft 55, by additional e-clips or c-clips at the inner ends of the turf brackets, or by a center support which will support the shaft 55 midway between the side members 13*a,b* of the frame. Alternatively, the turf bracket can be extended for the double frame, such that a single turf bracket extends across the double frame. The advantage, however, of having two separate turf brackets in the double frame, is that two separate turf sections can be provided in the double frame, which can then operate independently of each other.

The main frame 12' shown in FIGS. 6A-9 is slightly different from the main frame 12 of FIGS. 3A-D. In particular, the main frame 12' does not include the lip 39 extending forwardly from the top of the second end member 16*b* of the frame. Nor does the floor 19' include the raised projections 25. Rather, the floor 19' is flat or level. In all other respects, the frame 12' is the same as the frame 12. In the main frame 12, the lip 39 held the energy transfer pad 39 in place. However, eliminating the lip allows for the turf section 49 to be adhered to the energy transfer pad 43 at an end of the turf section and an end of the energy transfer pad remote from the shaft 55. As described above, by securing the turf section and the energy transfer pad together at this second end of the frame facilitates returning the turf section back to a "normal", "at rest" position after being struck with a golf club during a swing.

Figure 7:
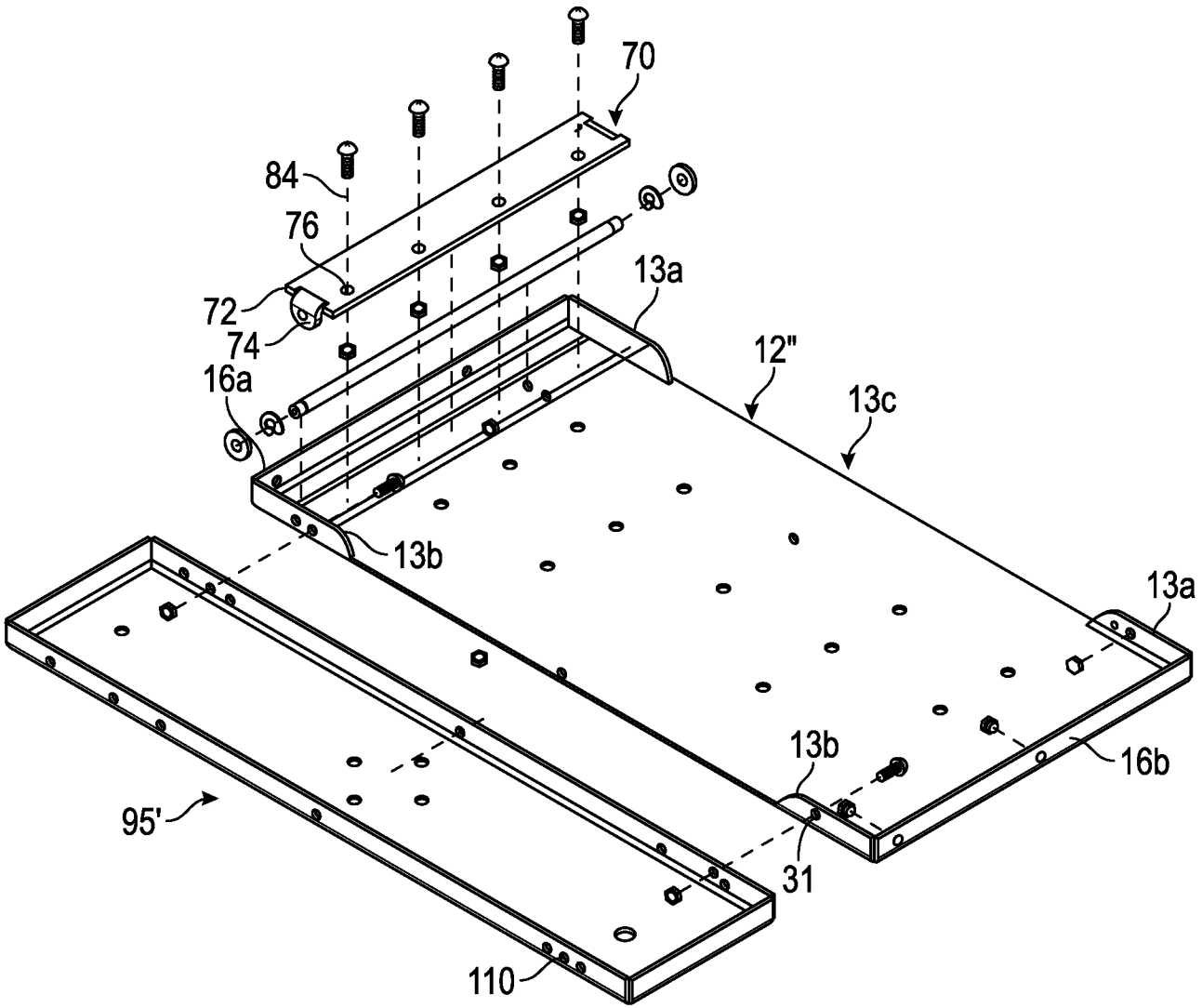
FIG. 7 is an exploded perspective view of a variation of the main frame of FIG. 6A, the tee box and a turf bracket which excludes a hold-down bar.
Figure 10A:
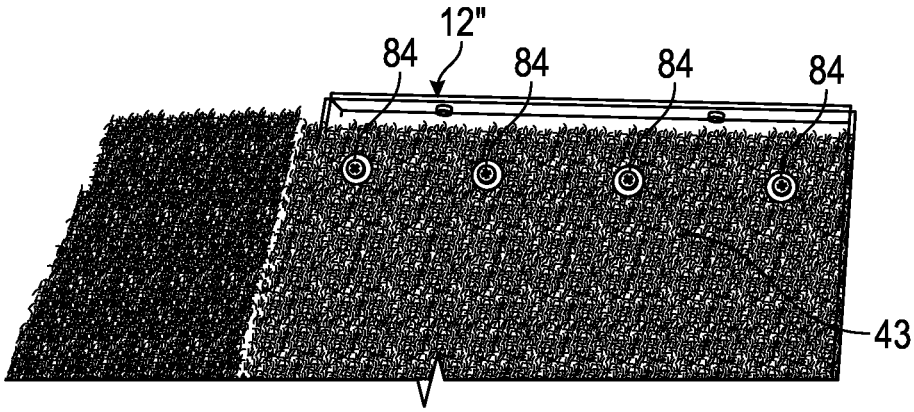
FIG. 10A is a fragmentary perspective view of the front end of the main frame with a turf assembly in the main frame and showing the fasteners connecting the turf assembly to the turf bracket.
Figure 10B:
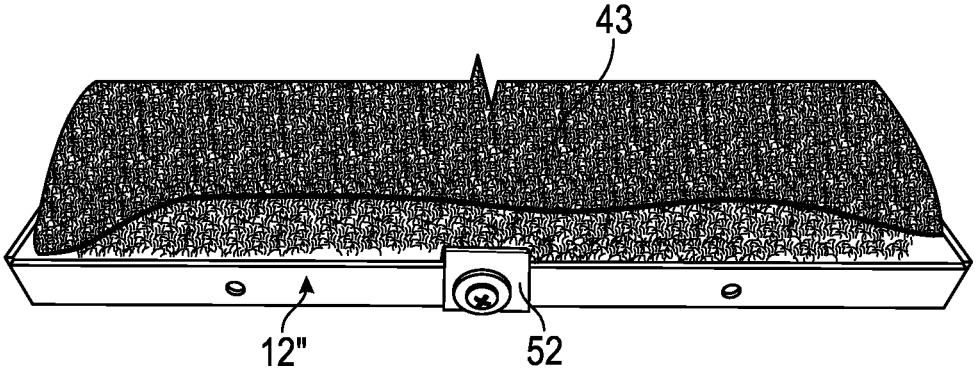
FIG. 10B is a fragmentary perspective view of the rear end of the main frame showing the strap connecting the turf assembly to the main frame.

A variation of the main frame 12' is shown in FIG. 7. The main frame 12" is substantially similar to the main frame 12', and thus only its differences will be pointed out. Initially, the main frame 12" is slightly larger than the frame 12'. In a preferred embodiment, the main frame is 11.5"×23.75". As seen, the side members 13*a,b* do not extend the full length of the frame. Rather, the side members each comprise a top portion extending rearwardly from the front wall 16*a* and a bottom portion extending forwardly from the back wall, thereby forming a gap 13*c* which extends a substantial distance of the side edge of the frame. Preferably, the gap is centered (i.e., the top and bottom portions of the side walls are substantially the same length), and has a length equal to about 66% of the overall length of the main frame. Thus, in a main frame that is 23.75", the gap is about 16" long, and the top and bottom portions of the side walls are each about 4" long. The provision of the gap 13*c* provides a wall free area on the golf practice platform. Golfers otherwise may strike the side wall with the heads of their clubs. Additionally, as seen, the turf mounting bracket comprises just the rocker plate 70. The hold down plate 80 has been omitted, and the turf section is adhered directly to the rocker plate by screws 84 (as seen in FIG. 10A) which extend through the turf section into threaded openings 76 in the rocker plate. The heads of the screws will be below the top of the "grass" of the turf, and thus the likelihood that a golfer will contact the screws with a golf club head is low. Lastly, the turf assembly used with the main frame 12" is preferably the turf assembly shown in FIG. 8 in which web reinforcement 50 extends the length of the energy absorbing pad 43, and the pad 43, turf section 40, and web reinforcement 50 are sewn together. In addition, the turf assembly can be provided with a flexible strap 52 (FIG. 8) which is connected at one end to proximate the back edge of the turf assembly and at another end to the back edge of the main frame. The strap 52 is of a length such that there will be at least some slack in the strap, and the strap 52 will define a loop as seen in FIG. 1 when the turf assembly is in its normal or rest position. The strap 52 will control the extent to which the turf assembly can move relative to the frame during a practice stroke.

In use, the golf practice platform 10 is recessed or set in an opening, such that the top surface of the turf 49 is generally even or level with the ground, deck, etc. into which the golf practice device 10 is set. Thus, when a golfer stands next to the golf practice platform, the golf practice platform will neither be elevated nor sunken relative to the golfer.

Figure 2C:
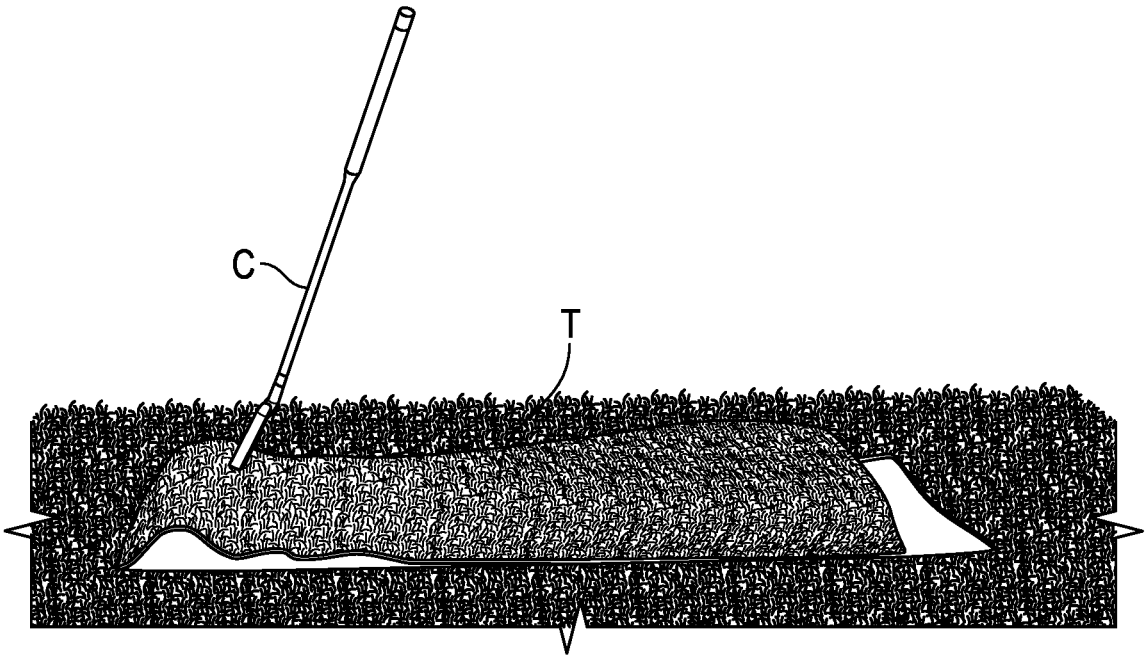
FIGS. 2C-D are a perspective views showing how a turf assembly of the golf training platform bends, flexes, and moves during a golf stroke when the golf club contacts the turf assembly (FIG. 2C) and after completion of the golf stroke (FIG. 2D)
Figure 2D:
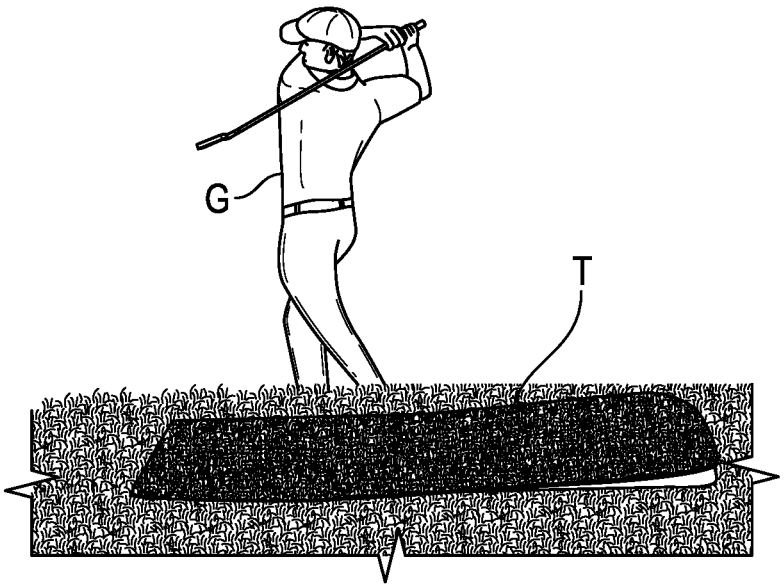

To use the golf practice platform 10, a golfer places a golf ball on the turf section 49 which is resting on the energy recover pad 43. During actual play, when a golfer drives a golf ball from the fairway (or rough), the golfer swings the club such that the head of the club hits the ground just in front of the golf ball. This creates a divot in the fairway (or rough). With the practice platform 10, the golfer can swing the golf club in the normal fashion (i.e., to hit the turf section just in front of the golf ball). Because the turf section 49 is lying on the energy recover pad 43, when the swinging golf club head impacts the turf section 49, the turf section will rock forward, the rear of the turf section will move forwardly, and the front of the turf section will swell or form a wave, as seen in FIG. 2C. If the turf section is not secured to the energy recovery pad, the turf section will separate from the energy recover pad, and the energy recovery pad may remain substantially in place. If the turf section and energy recovery pad are connected together, the energy recovery pad and turf section will move together. This has been found to simulate the grass breaking away and the formation of a divot during a golf swing, and provides a lifelike simulation of the creation of a divot when contacted by a swinging golf club. Further, the energy recovery pad 43 is springy, and absorbs the energy of the impact of the golf club head with the turf section 49. This substantially reduces, if not eliminates, vibrations from the impact from traveling up the club shaft to the golfer's hands.

Figure 11A:
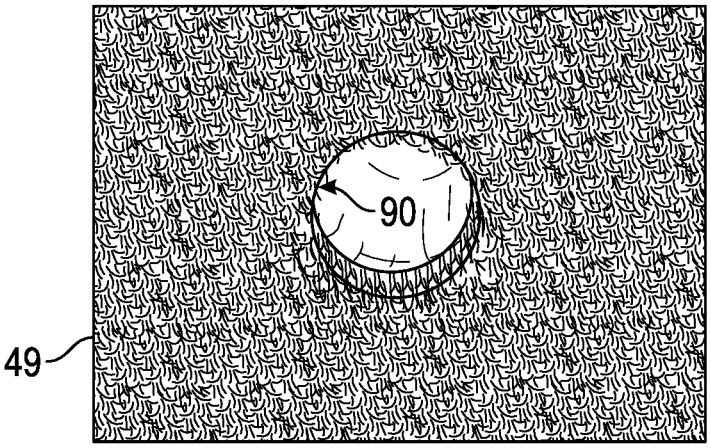
FIG. 11A shows a top plan view of a turf section with a golf ball receiving depression or hole formed therein.
Figure 11B:
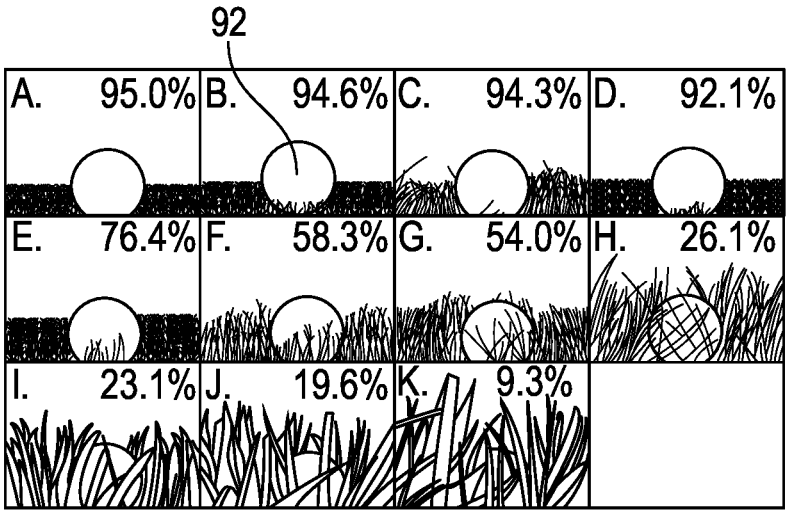
FIG. 11B shows golf balls received in depressions or holes of varying sizes in the turf.
Figure 12A:
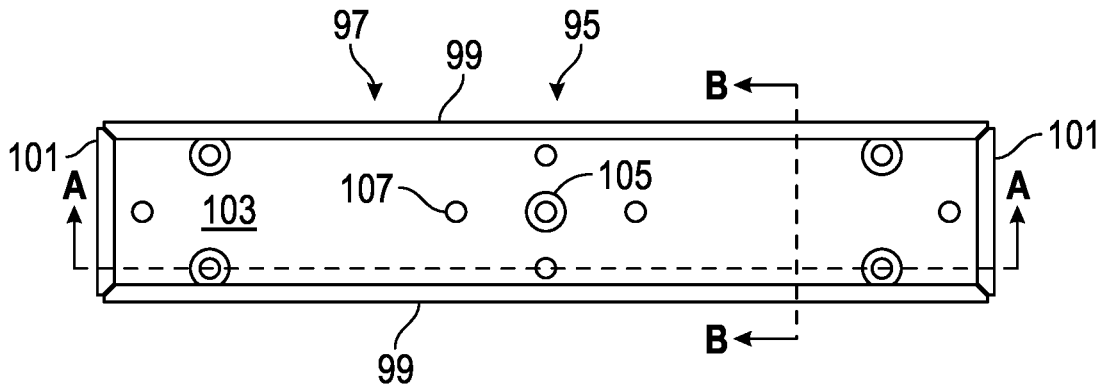
FIG. 12A is a top plan view of a tee box frame.
Figure 12B:
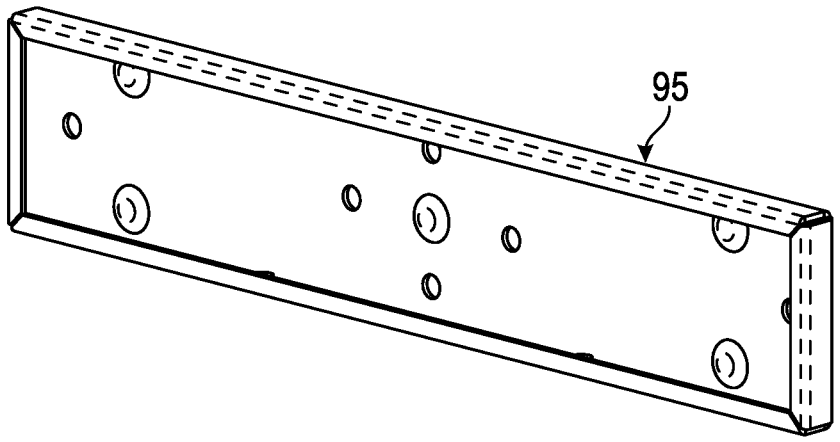
FIG. 12B is a perspective view of the tee box frame.
Figure 12C:
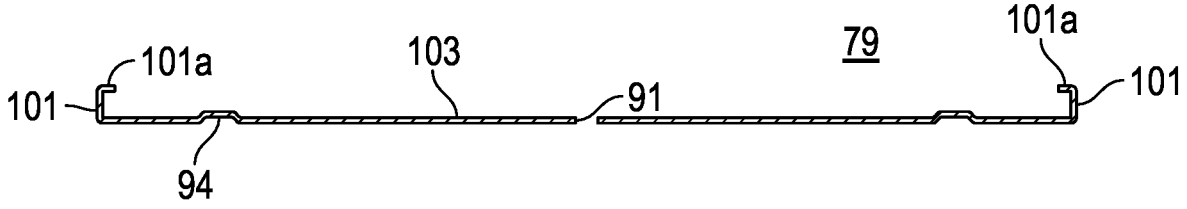
FIG. 12C is a cross-sectional view of the tee box frame taken along line A-A of FIG. 12A.
Figure 12D:
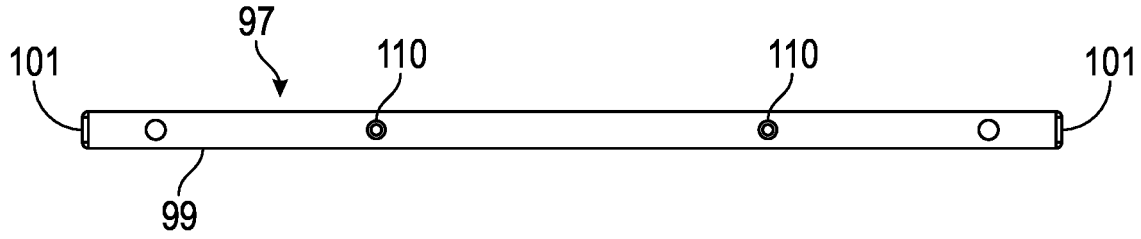
FIG. 12D is a side elevational view of the tee box frame.
Figure 12E:
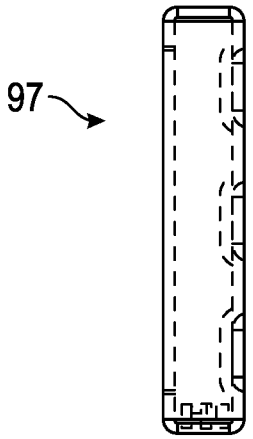
FIG. 12E is an end elevational view of the tee-box frame, with elements of the floor of the tee-box frame being shown in phantom.
Figure 12F:
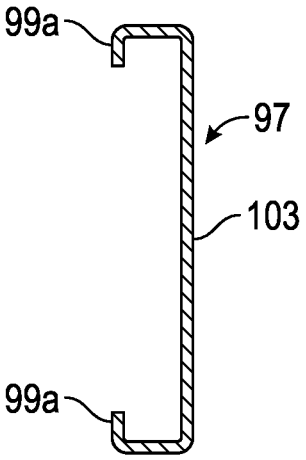
FIG. 12F is a cross-sectional view of the tee-box frame taken along line B-B of FIG. 12A.

To further, and better, simulate the golfing experience, the turf section 49 is preferably provided with a depression, indentation, or hole 90 (FIG. 12A 11A) in the turf section 49. This indentation is preferably formed by cutting a circular hole in the turf section. This hole 90 has a diameter that is less than the diameter of a golf ball (i.e., less than about 1.7"). To provide a clean edge in the turf section, the hole 90 can provided with a grommet (not shown) or the like which is received in the edge of the hole. The golf ball 92 is placed in (on) the hole 90, and, as seen in the various views of FIG. 12B 11B, depending on the size of the hole relative to the diameter of the golf ball, the depth to which the golf ball 92 "sinks" into the turf will vary. The ability to provide different depths to which the golf ball can rest in the turf section, along with the capability to change out the turf section 49 to provide with different types of turf affords the golfer the ability to practice a wide variety of lies and swings. A plurality of turf sections 49 with depressions 90 of varying depths may be used in a practice session.

Turning to FIGS. 12A-F, the golf practice platform can also be provided with a tee box 95. Illustratively, the tee box 95 has the same dimensions as the small frame. Thus the tee box can have a length substantially equal to the length of the main frame 12, 12', 12" and a width that is one-half the width of the main frame. In the embodiment of FIG. 7, the tee box 95' has a width of about 5.75" and a length of about 23.75". The tee box 95 comprises a tee box frame 97 having a floor 103 and side members 99 and end members 101 which extend upwardly from the edges of the floor. The side and end members 99, 101 define interior space of the tee box frame.

As with the floor 19 of the frame 12, the floor 103 of the tee box frame 95 can include a plurality of projections 105 and drain holes 107, which are identical to the projections 25 and drain holes 28 for the frames 12. As seen in FIG. 6A, the projections 105 and drain holes 107 are arranged in a different pattern than the projections and drain holes of the main frame 12. Alternatively, the floor of the tee box can be flat (i.e., free of projections).

The side members 99 and end members 101 can be in the shape of an inverted L, which form lips 99*a* and 101*a* which extend generally horizontally from the top edge of each of the end and side members over the floor 103 towards the opposite end and side member, respectively. The tee box frame 97 receives a turf section. Because golfers do not form divots as frequently when teeing off, the tee box 95 need not include an energy recover pad beneath the turf section. However, an energy recovery pad could be provided if desired, and would be desirable to at least raise the turf section so that the turf section in the tee box is level with tops of the side and end members of the tee box. As with the main frame 12, the turf assembly sits on the projections 105. Preferably, the energy recover pad will rest on the projections 105, and the turf section will rest on the energy recover pad. The turf section, and energy recovery pad, if provided, are preferably sized to snuggly fit within frame members 99, 101, such that the lips 99*a*, 101*a* will extend over the turf section to retain both the turf section and the energy recover pad in the tee box frame 97. The turf section (and energy recovery pad, if provided) have depths, such that the overall depth causes the edges of the turf section to be slightly compressed when inserted into the tee box frame 97. This compression will further help hold the turf section in the tee box frame, and will thus eliminate the need for adhesives to hold any of the parts in the tee box frame.

In an alternative, as seen in FIG. 7, the tee box can be formed without the lips extending inwardly from the end and side members of the frame or the projections in the floor. In this instance, the turf assembly will rest upon a substantially flat floor (or on the projections) and can be secured in place with fasteners, such as bolts, snaps, or hook-and-pile fasteners (such as Velcro® strips). Alternatively, the turf section can be sized to be wedged in place between the side members and end members, so as to be frictionally held in place.

A tee 106 can be positioned within the turf section 49 of the tee box, as seen in FIG. 2. The tee 106 can be generally cylindrical in shape or in the shape of a common golf tee and positioned to protrude generally perpendicularly from the top surface of the turf section. The diameter of the cylindrical shaped tee 106 is such that the golf ball 92 may stably rest atop the tee for the golfer to practice his tee-off swing. The commonly shaped tee, as is known, has an enlarged head portion upon which the golf ball rests. The common golf tee has a slender post with a pointed end, and can be inserted right into the turf 49. The wider cylindrical tee has a base which is positioned between the turf and the tee-box floor. The tee itself will then project through a hole formed in the turf.

Preferably, the main frames and tee box frames can be connected together thereby expanding the golf training platform to allow for practicing teeing off. Thus, the frames can be connected side to side or end to end (i.e., in tandem). To connect the frames together the frames all have holes in their respective side and end members. The large and small frames have holes 31 in their side members and holes 37 in their end members. The tee box frame 97 has holes 110 in its side members and can include holes in its end members (although such holes are not shown). The holes in the respective frames are all positioned so that they will be aligned when the frames are placed side-to-side or end-to-end. To connect the frames, one set of side members and one set of end members of each frame are provided with internally threaded bolts. For example, the holes in the right side members and the top end members of each frame can be provided with nuts. Thus, when the frames are arranged to be adjacent each other, a screw can pass through the unthreaded left (or bottom) frame member into the threaded nut of the adjacent right (or top) frame member to thereby secure frames together.

Although the frames are described as being connected by screws and bolts. The frames could be connected by any other desired means. For example, shafts could extend through the side and end member opening and associated C- or e-clips could be used to hold the frames together. The frames could be provided with protruding buttons on one side and end, and associated bayonet slots on the opposite side and end. The frame members could then be slidingly connected together. Any other conventional means can be used to connect the frames together.

Figure 13:
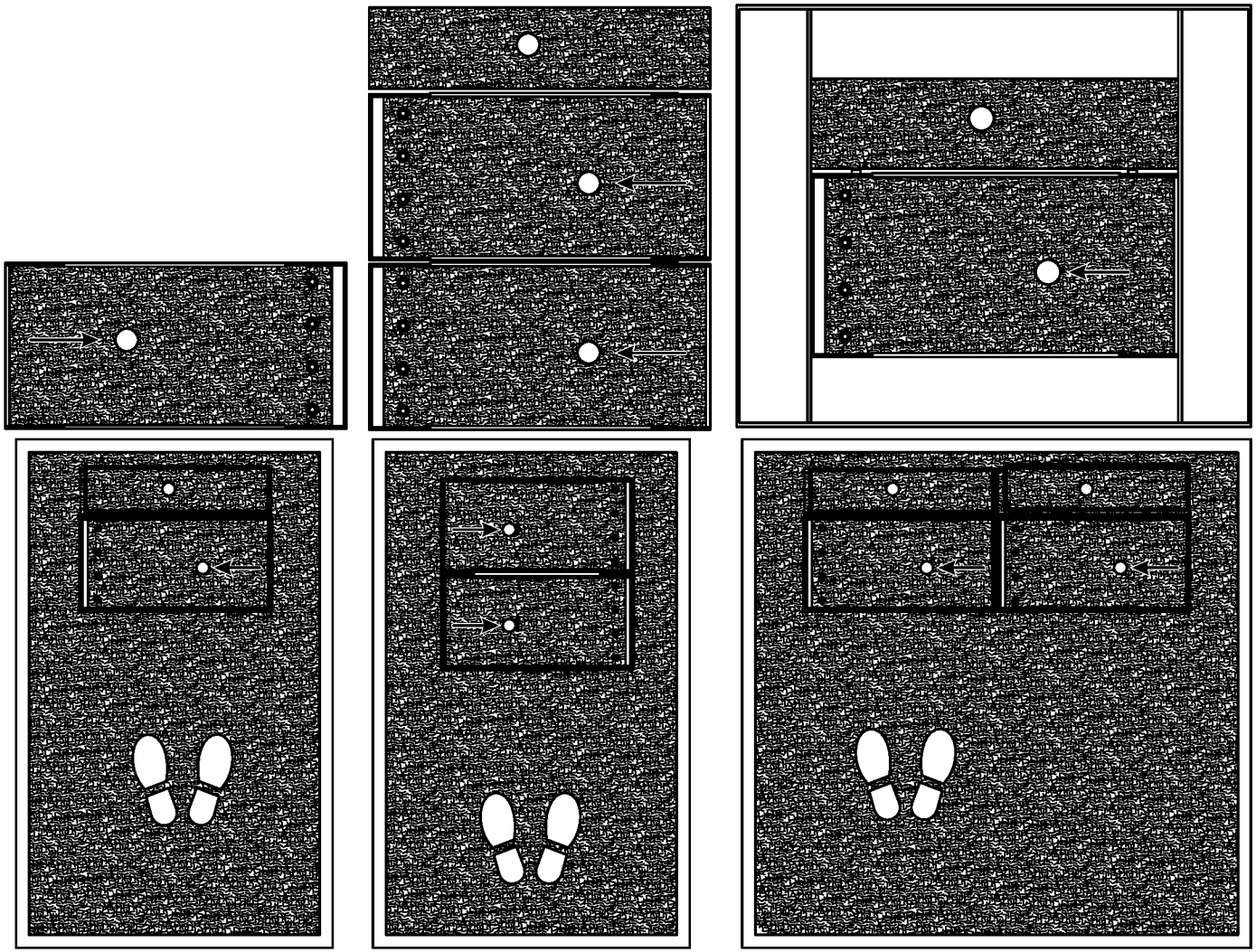
FIG. 13 shows frames connected in a variety of configurations for practicing various types of lies.

The ability to connect the various frames together allow for a driving range to provide golf practice platforms in a number of configurations. The double frames, single frames, and tee-boxes can be used individually. However, as seen in FIG. 13, multiple main frames and tee boxes, or a combination of main frames and tee boxes can be connected in a variety of configurations to allow a golfer to practice from multiple types of turfs with varying depression depths at one time. FIG. 13 show various combinations of tee-boxes and main frames. As seen, because they are of the same dimensions, the frames can be assembled together in a variety of arrayed configurations, from 1×1 to 4×4, or any desired configuration. The configuration need not be limited to an array. Further, the tee-boxes can be connected to the double frame, and double frames can be connected together in the same way as shown in FIGS. 7 and 13. Further, the double frame and single can be connected together, again in most any desired configuration. When multiple frames are assembled together, the various frames can be set up for left handed or right handed golfers, and/or the various frames of one assembly can be provided with different types of turf, as noted above.

Finally, the golf practice platform can be inserted into a golf mat, such as commonly found in driving ranges. For example, one or two units (i.e., one or two frames) can be inserted into a 5'×5' golf mat. Thus, driving ranges can be easily retrofitted to incorporate the golf practice platform.

As various changes could be made in the above constructions without departing from the scope of the invention, it is intended that all matter contained in the above description or shown in the accompanying drawings shall be interpreted as illustrative and not in a limiting sense. For example, although the frames are shown to be rectangular, they could be any desired shape. Preferably the frames will be in the shape of a polygon, and preferably a regular polygon, to facilitate connection of the frames. The frame 12, 12, 12", the tee box frame 95, 95', and the interchangeable turf sections 49 may be varied in size. The length of the respective side members and/or end members may be varied to change the length and/or width of the golf practice device. The frames could be provided without floors. In this case, at least the side members will include inwardly directed bottom flanges on which the energy transfer pad will sit. The rocker plate could be eliminated, and the turf section could be secured directly to the shaft 25.

These examples are merely illustrative.

The invention claimed is:

1. A golf training platform comprising:

a frame comprising a first side member and a second side member fixed in a position relative to each other;

a turf bracket pivotally mounted between said first and second side members of said frame to pivot about an axis substantially perpendicular to said side members; and a turf section secured to said turf bracket proximate a first end of said turf section; said turf section comprising a flexible turf-simulating material; the turf section being secured to said turf bracket only along said first end of said surf section; whereby said turf section will deform, flex, and/or bend upon being contacted by a swinging golf club;

wherein said turf bracket comprises a rocker plate to which said turf section is secured.

2. The golf training platform of claim 1, further comprising a compressible energy transfer pad positioned in the frame between the first side member and the second side member; wherein the turf section is set atop said compressible energy transfer pad.

3. The golf training platform of claim 2 wherein said turf section is secured to said energy transfer pad.

4. The golf training platform of claim 3 wherein the turf section is secured to the energy transfer pad proximate an end of said turf section remote from said first edge of said turf section.

5. The golf training platform of claim 3 wherein the turf section is secured to the energy transfer pad along the substantially a full length of the energy transfer pad.

6. The golf training platform of claim 5 wherein the turf assembly comprises a web reinforcement secured to a surface of the energy transfer pad.

7. The golf training platform of claim 6 wherein the web reinforcement extends substantially the length of the energy transfer pad.

8. The golf training device of claim 2 wherein the energy transfer pad comprises an open cell foam.

9. The golf training device of claim 8 wherein the energy transfer pad is made from a polyester, polyether, or polyurethane foam having a PPI (pores per inch) of less than 20.

10. The golf training platform of claim 2 wherein the compressible energy transfer pad is composed of an open cell foam.

11. The golf training platform of claim 1 wherein said turf mounting bracket further includes a hold down plate; whereby said turf section is clamped between said rocker plate and said hold down plate.

12. The golf training platform of claim 1 wherein said turf section is removably secured to said rocker plate.

13. The golf training platform of claim 1, further comprising a tee box secured to the main frame, the tee box comprising a pair of opposed sides and a pair of opposed ends which in combination define an enclosed space and a tee box turf section received in said enclosed space.

14. The golf training platform of claim 13, further comprising at least one fastener configured to attach the tee box to the main frame.

15. The golf training platform of claim 14, wherein at least one of said sides of the main frame comprises at least one side hole, and at least one of said sides of the tee box comprises at least one side hole; the side holes of the main frame and the side holes of the tee box being positioned such that said side holes of said main frame and tee box are aligned when the tee box is adjacent to the main frame; said fastener comprising a rod passing through the respective holes when the frame and the tee box are adjacent.

16. The golf training platform of claim 15 wherein the rod is threaded, and wherein one of the at least one side holes of said main frame and said tee box is threaded for receiving the threaded rod.

17. The golf training platform of claim 1 wherein the turf assembly defines an upwardly opening depression or hole sized such that when a golf ball is positioned in the depression or hole, a bottom of the golf ball will be below a top surface of the turf assembly a desired amount.

18. A golf training platform comprising:

a main frame having two opposed sides defining a space therebetween;

a flexible, deformable turf assembly positioned within the space defined by the sides of the frame; said turf assembly comprising a turf section and an energy transfer pad, the flexible deformable turf section being above the energy transfer pad; and a turf bracket mounted in said main frame for pivotable movement about an axis generally perpendicular to said opposed sides;

wherein said turf assembly is removably mounted to said turf bracket; said turf bracket comprising a plurality of positioning members, and said turf assembly defining a plurality of a notches at said forward end that align with said positioning members of said turf bracket; said positioning members being movable between a clamped position and an unclamped position; wherein in the clamped position, the turf assembly is secured to said turf bracket, and in the unclamped position, the turf assembly is removable from the turf bracket;

wherein the turf assembly is mounted in the main frame only proximate a forward edge of the turf assembly, whereby said turf assembly is adapted to bend and/or flex when contacted by a swinging golf club.

* * * * *